US005922160A

United States Patent [19]

Audisio

[11] Patent Number: 5,922,160

[45] Date of Patent: Jul. 13, 1999

[54] METHOD AND MACHINE FOR PRODUCING A RING OF ABRASIVE SHEET ELEMENTS FROM WHICH TO FORM A ROTARY BRUSH

[75] Inventor: Riccardo Audisio, Fossano, Italy

[73] Assignee: Bibielle S.p.A., Italy

[21] Appl. No.: 08/942,711

[22] Filed: Oct. 1, 1997

Related U.S. Application Data

[51] Int. Cl.[6] ..... B32B 31/18; B24D 18/00

[52] U.S. Cl. ..... 156/257; 156/264; 156/293; 156/305; 156/517; 156/522; 156/524; 156/526; 156/578

[58] Field of Search ..... 156/257, 264, 156/291, 293, 305, 510, 517, 529, 522, 558, 523, 524, 527, 578, 526

[56] References Cited

U.S. PATENT DOCUMENTS 3,727,353 4/1973 Pixley .
3,729,872 5/1973 Hall, Jr. .
4,518,452 5/1985 Hundebol ..... 156/257 X
5,542,875 8/1996 Ichiguchi .

FOREIGN PATENT DOCUMENTS 2 735 059 12/1996 France .
2 735 060 12/1996 France .
2 737 431 2/1997 France .
19 714 028 10/1997 Germany .

*Primary Examiner*—Curtis Mayes
*Attorney, Agent, or Firm*—Alan H. Gordon

[57] ABSTRACT

A method and machine for producing a ring of abrasive sheet elements from which to form a rotary brush, and whereby the abrasive sheet elements are formed into an orderly row of abrasive elements of a length substantially equal to the mean circumference of the ring, and are connected to one another by feeding towards the row a flexible connecting element, and by connecting the flexible connecting element integrally to each of the sheet elements prior to curving the row to form the ring.

18 Claims, 3 Drawing Sheets

METHOD AND MACHINE FOR PRODUCING A RING OF ABRASIVE SHEET ELEMENTS FROM WHICH TO FORM A ROTARY BRUSH

BACKGROUND OF THE INVENTION

The present invention relates to a method of producing a ring of abrasive sheet elements from which to form a rotary brush comprising a hub and a ring of abrasive sheet elements substantially projecting from and connected integrally to the hub.

Rings of abrasive elements of brushes of the above type are known, from Italian Patent n. 219581 filed on Feb. 23, 1990 by the present Applicant, to be formed by first forming a number of abrasive sheet elements from reels of abrasive material in strip form; forming the abrasive elements into an orderly succession positioned on edge; arranging the abrasive elements in a ring directly about the hub; and bonding the ring integrally to the hub.

The sheet elements are arranged about the hub by dividing the orderly succession into a number of rows of sheet elements, each row of a length substantially equal to the mean circumference of the ring being produced; and each row of sheet elements is taken manually and gradually wound, again manually, about the hub by skilled workers using specially designed equipment.

Though used, the above known method involves several drawbacks.

In particular, the need for skilled labour and specially designed equipment results in fairly high manufacturing cost and low output; while the brushes so formed are invariably of inconsistent quality. That is, before being bonded to the hub, the sheet elements are subject to slippage, thus resulting in loss of symmetry and impaired efficiency of the finished brush, often to the extent of the brush being rejected, thus further reducing output.

SUMMARY OF THE INVENTION

It is an object of the present invention to provide a straightforward, low-cost method of producing a ring of abrasive sheet elements from which to form a rotary brush, designed to overcome the aforementioned drawbacks.

According to the present invention, there is provided a method of producing a ring of abrasive sheet elements from which to form a rotary brush comprising a central core and a ring of sheet elements substantially projecting from the central core; the method comprising the steps of forming an orderly row of sheet elements, and curving the row to form said ring; and the method being characterized by comprising the further steps of feeding at least one flexible connecting element towards said row of sheet elements; and connecting each of said sheet elements integrally to the flexible connecting element prior to curving said row of sheet elements.

It is a further object of the present invention to provide a machine for producing a ring of abrasive sheet elements from which to form a rotary brush.

According to the present invention, there is also provided a machine for producing a ring of abrasive sheet elements from which to form a rotary brush comprising a central core and a ring of sheet elements substantially projecting from the central core; the machine comprising forming means for forming an orderly row of sheet elements, which is curved to form said ring; and the machine being characterized by comprising first feeding means for feeding at least one flexible connecting element towards said row of sheet elements; and connecting means for connecting each of said sheet elements integrally to said flexible connecting element prior to curving said row of sheet elements to form said ring.

BRIEF DESCRIPTION OF THE DRAWINGS

A non-limiting embodiment of the present invention will be described by way of example with reference to the accompanying figures, in which.

DETAILED DESCRIPTION OF THE INVENTION

Figure 1:
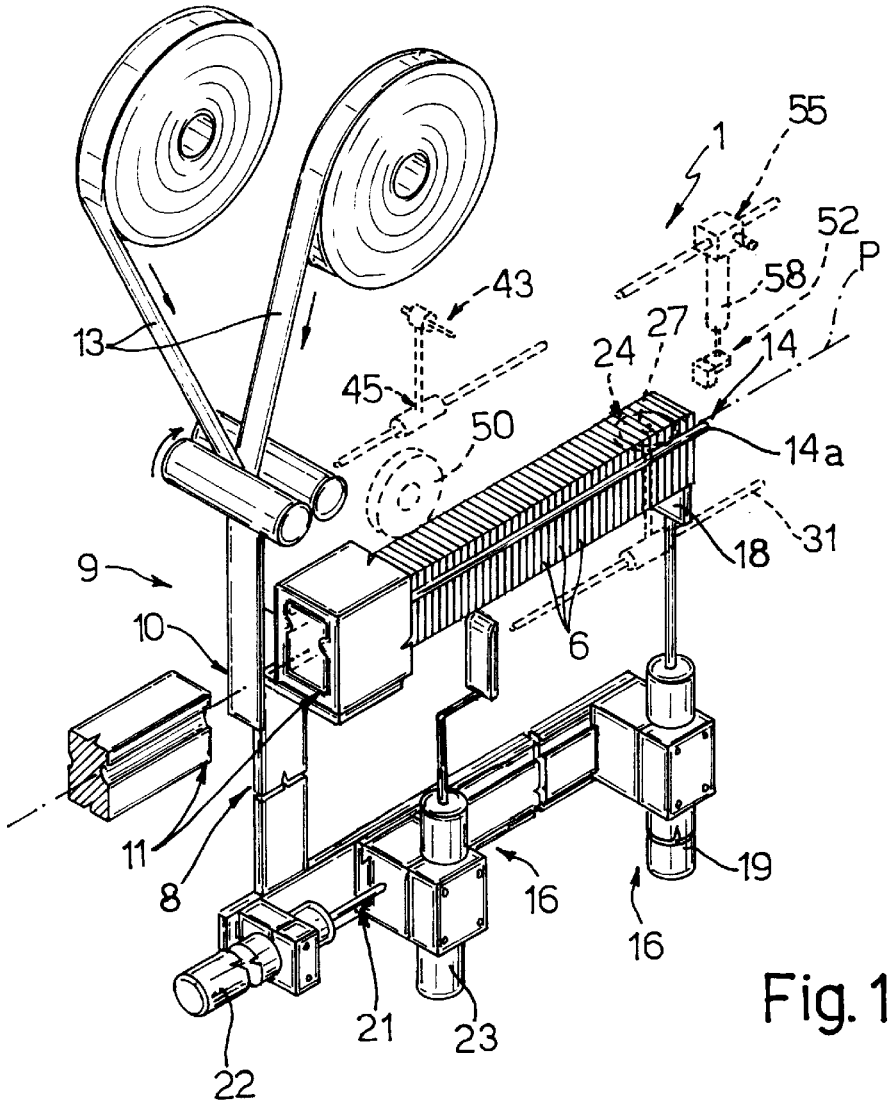
FIG. 1 shows a schematic view in perspective, with parts removed for clarity, of a preferred embodiment of a machine for producing rings of abrasive sheet elements from which to form rotary brushes, and in accordance with the teachings of the present invention.
Figure 5:
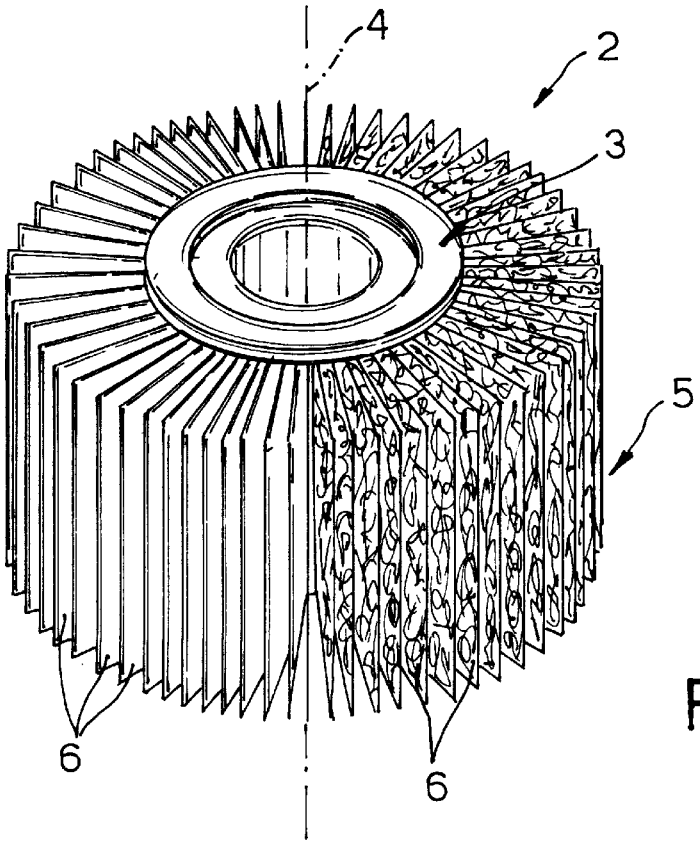
FIG. 5 shows a brush formed on the machine shown in FIGS. 1 to 4.

Number 1 in FIG. 1 indicates a machine for producing rotary abrasive brushes 2 (FIG. 5), each comprising a hub 3 with an axis 4, and an abrasive ring 5 surrounding hub 3. Ring 5 is connected integrally to hub 3 by a coating of adhesive material (not shown), and comprises a number of abrasive sheet elements 6 connected in projecting manner to hub 3 and made of abrasive cloth or known abrasive sponge material.

Machine 1 comprises a frame 8; and a known assembly 9 for forming an orderly succession of sheet elements 6 on edge, and which is preferably of the type described in Italian Patent n. 219581 filed on Jan. 23, 1990 by the present Applicant, and to which full reference is made herein as required in the interest of full disclosure.

More specifically, assembly 9 comprises a cutting station 10 equipped with known shears 11 for successively forming from strips 13 a number of elements 6, each having two opposite lateral recesses 12 (FIGS. 2 and 4); and, downstream from shears 11, elements 6 are engaged by a straight guide 14 defined by two spaced parallel cylindrical rods 14*a* engaging respective recesses 12, and are fed along a straight path P to a connecting station 15 (FIG. 2) for connecting elements 6 to one another.

Station 15 houses a dividing assembly 16 for dividing elements 6 engaged by guide 14 into a number of rows 17 of elements 6, each row being of a length L substantially equal to the mean circumference of ring 5.

Figure 2:
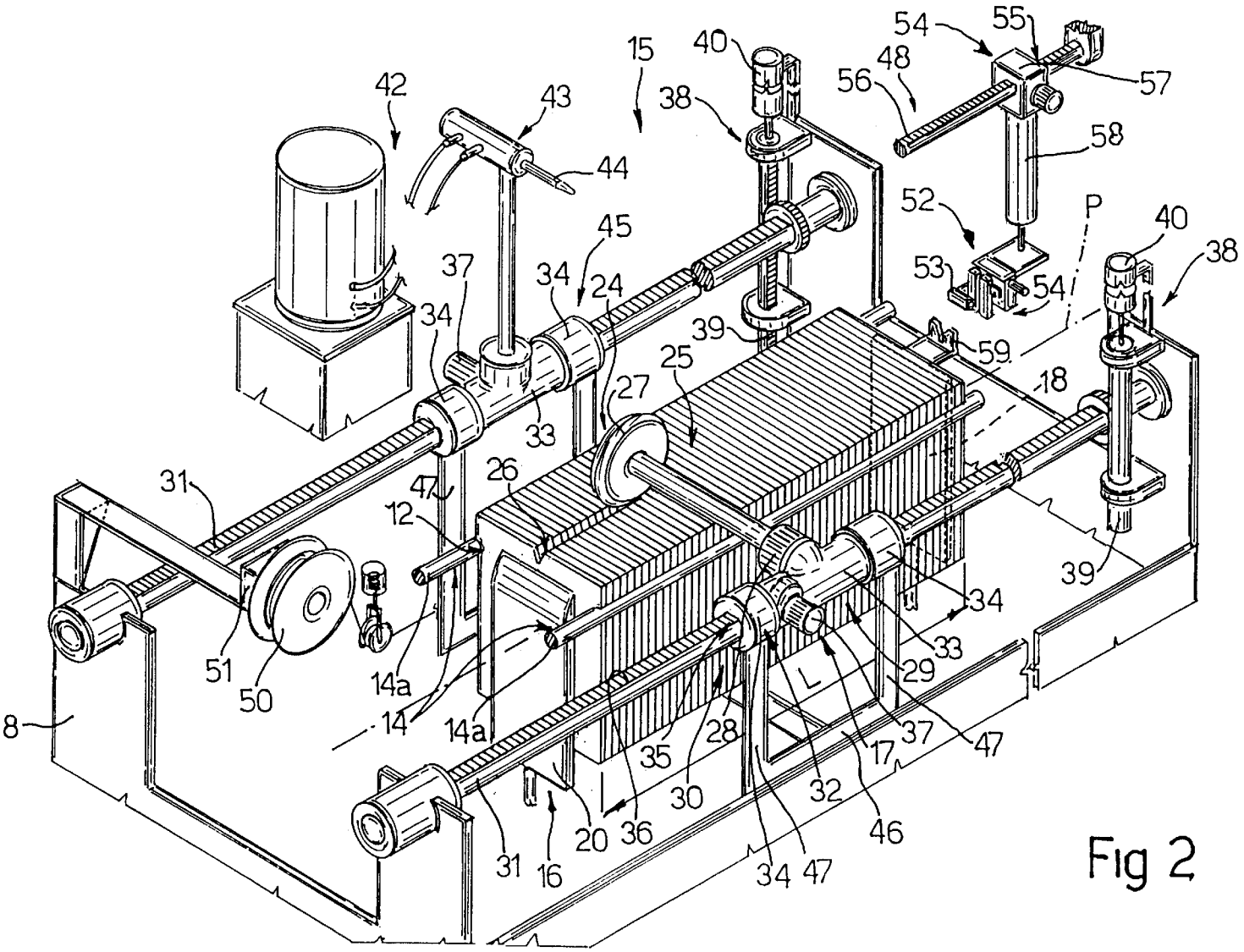
FIG. 2 shows a larger-scale schematic view in perspective of a group of FIG. 1 elements in a different operating position.

As shown in FIG. 2, assembly 16 comprises a movable stop plate 18, which moves with respect to frame 8 in a direction perpendicular to path P and guide 14, and which is moved, with respect to frame 8 and by a pneumatic actuator 19, between a lowered rest position permitting row 17 to be fed along guide 14, and a raised stop position (FIGS. 1 to 3) extending along path P and contacting the first element 6 in row 17 at station 15. Assembly 16 also comprises a dividing and thrust blade member 20 connected to frame 8 by a known guide and slide assembly 21 (FIG. 1), and which is moved in a direction parallel to path P by a known pneumatic actuator 22, and is also movable, with respect to frame 8 and in a direction perpendicular to path P and rods 14*a* by a further pneumatic actuator 23, between a lowered rest position (FIG. 1) extending beneath guide 14 and outwards of elements 6 engaged by guide 14, and a raised operating position (FIGS. 2 and 3) extending between rods 14*a* and contacting the last element 6 in row 17 with sufficient force, in use, to compact row 17 against stop plate 18.

As shown in FIG. 2, machine 1 also comprises a cutting assembly 24 located at station 15, and which provides for cutting a longitudinal groove 26 in a surface 25 of row 17 defining the inner surface of ring 5. More specifically, assembly 24 comprises an abrasive cutting disk 27 fitted to the output shaft of a motor 28; and an actuating device 29 for moving disk 27.

Device 29 comprises a guide and slide assembly 30, the guide of which is defined by a straight rod 31 extending parallel to rods 14*a* and having opposite end portions connected in rotary and axially-fixed manner to frame 8. Assembly 30 also comprises a slide 32 in turn comprising a tubular central portion 33 and two tubular lateral portions 34; each lateral portion 34 is connected to central portion 33 in axially-fixed manner so as to rotate about the axis of rod 31, and is connected in rotary and axially-sliding manner to rod 31; and central portion 33 is connected in axially-sliding angularly-fixed manner to rod 31, and is moved in both directions along rod 31 by an actuating assembly 35 comprising a rack 36 fitted to rod 31, and a pinion (not shown) meshing with rack 36 and fitted to the output shaft of a respective motor 37 connected to portion 33.

Portion 33 is fitted integrally with motor 28, and is rotated with respect to frame 8 and about the axis of rod 31 by rod 31 itself, which is powered by a known actuating assembly 38. In the example shown, assembly 38 comprises a rack and pinion assembly, the rack 39 of which is connected to a pneumatic linear actuator 40 for rotating rod 31 about its axis and simultaneously rotating disk 27 between a cutting position (FIG. 2) resting on row 17 to form groove 26 in surface 25, and a raised rest position (shown by the dotted line in FIG. 1) in which disk 27 is positioned substantially over rod 31.

As shown in FIG. 2, machine 1 also comprises a bonding assembly 42 also located at station 15 and for bonding sheet elements 6 to one another.

More specifically, assembly 42 comprises a known dispensing device 43 (not described in detail) having a nozzle 44; and an actuating device 45 for moving nozzle 44 in both directions parallel to path P and depositing a bead A of elastic adhesive material inside groove 26. In the example shown, device 45 is located on the opposite side to device 29 with respect to a vertical plane through path P, and is constructed the same way as device 29; and devices 29 and 45 are connected integrally to each other, so as to travel together along path P, by a movable U-shaped frame 46 having two pairs of arms 47, each pair connected integrally to lateral portions 34 of a respective slide 32.

Machine 1 also comprises a device 48 for inserting inside groove 26 a portion 49 of flexible wire or strip material for internally reinforcing bead A of adhesive material.

Device 48 is housed inside station 15, and comprises a reel 50 of said wire, which reel is located, in use, upstream from row 17 in station 15, and is connected to frame 8 in rotary manner via the interposition of a known brake assembly 51.

Figure 3:
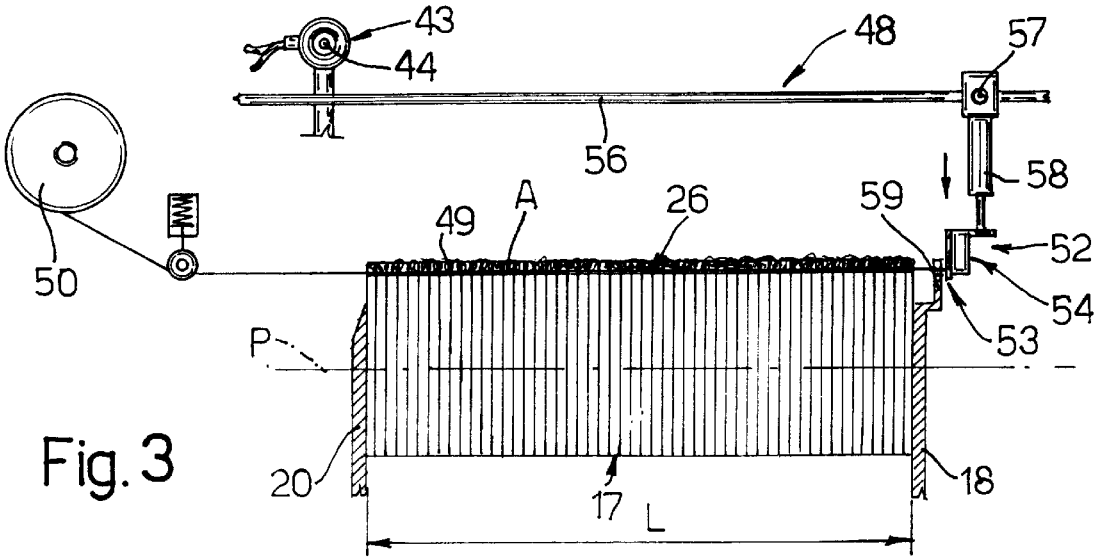
FIG. 3 shows a schematic side view of the FIG. 2 group in a further different operating position.

Device 48 also comprises an assembly 52 for gripping and unwinding the wire off reel 50, and in turn comprising a known powered, preferably pneumatic, gripper 53, and known shears 54 associated with and located downstream from gripper 53 in the traveling direction of elements 6. Assembly 52 also comprises a powered guide and slide assembly 55 for moving gripper 53 and shears 54 parallel to path P, and in turn comprising a straight guide 56 extending parallel to path P and over guide 14, and a slide 57 to which gripper 53 and shears 54 are connected via the interposition of a pneumatic linear actuator 58. Actuator 58 provides for moving gripper 53 and shears 54, in a direction perpendicular to guide 14 and path P, between a raised position (FIG. 2) in which gripper 53 is located adjacent to row 17 and over guide 14, and a lowered position in which, when assembly 52 is located adjacent to stop plate 18, gripper 53 holds wire portion 49 inside groove 26 and forces an end portion of wire portion 49 inside a catch 59 on plate 18 (FIG. 3).

Figure 4:
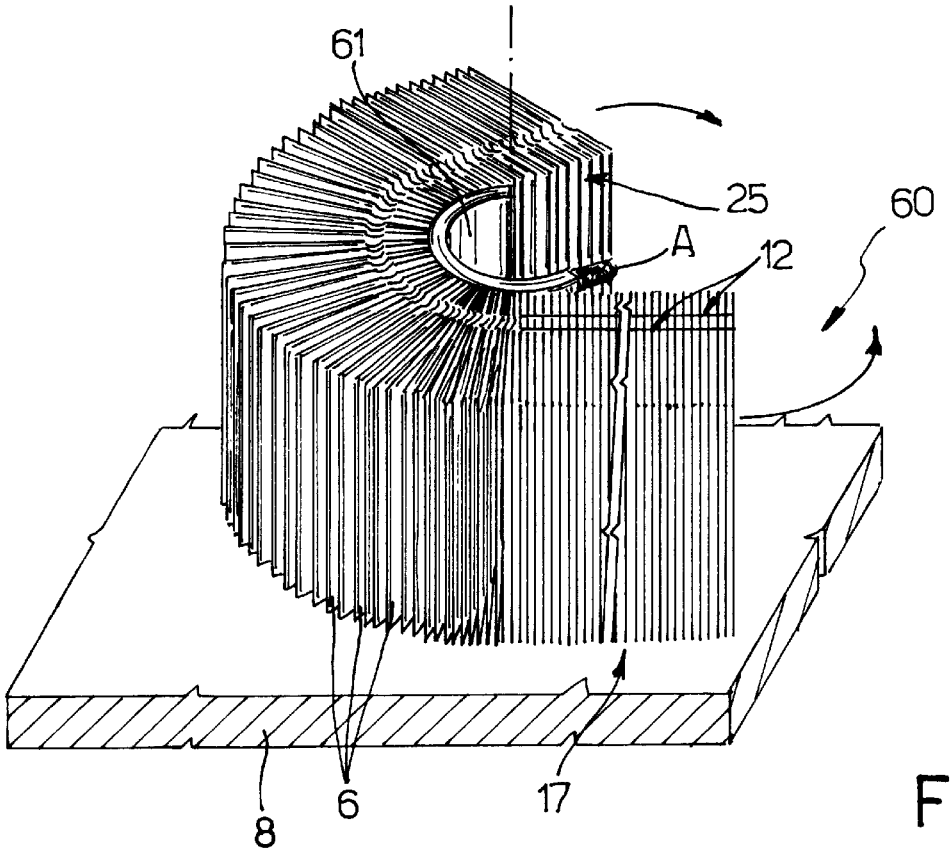
FIG. 4 shows a view in perspective of an end assembly of the FIG. 1 machine.

As shown in FIG. 4, machine 1 also comprises a forming station 60 for forming rings 5, located downstream from station 15 along path P, and where row 17 formed in station 15 is curved in known manner, preferably about a tubular reference body 61, to bring the first and last element 6 in row 17 into contact with each other.

Operation of machine 1 will now be described as of the condition in which plate 18 is in the raised position; blade member 20 is in the lowered position; disk 27 and nozzle 44 are both in the raised rest position adjacent to reel 50; elements 6 define a continuous succession extending between shears 11 and plate 18; and gripper 53 is located in the raised position upstream from member 20, and grips one end of the wire.

As of the above condition, member 20 is first raised and then moved towards plate 18 so as to compact elements 6 and form in station 15 a row 17 of a length L substantially equal to the mean circumference of ring 5. At this point, disk 27 is rotated about its axis, and actuator 40 and motor 28 are then activated successively so that disk 27 is first brought into contact with surface 25 and then moved towards plate 18 to form groove 26. Once groove 26 is formed, disk 27 is restored to the raised position and, at the same time, gripper 53 is moved towards plate 18 to unwind the wire off reel 50 and over row 17. As gripper 53 passes plate 18, brake 51 is activated to arrest reel 50 and the wire, and actuator 58 lowers gripper 53 to insert the wire inside groove 26 and lock the end of the wire inside catch 59.

At this point, gripper 53 releases the wire and is first raised and then restored to its position upstream from member 20 to engage an intermediate portion of the wire; and nozzle 44 is moved by actuator 40 into the operating position and then along groove 26 towards shears 11. As it travels towards shears 11, nozzle 44 deposits bead A of adhesive material inside groove 26, which is filled to embed wire portion 49.

As soon as the adhesive material sets, shears 54 on gripper 53 cut the wire transversely; plate 18 is lowered to detach wire portion 49 from catch 59; and member 20 feeds row 17 to ring forming station 60 where the portions of bead A and the ends of wire projecting axially outwards of row 17 are removed, e.g. by means of a disk cutter, and row 17 is curved in known manner to bring the first and last element 6 of row 17 into contact with each other, and so that bead A and wire portion 49 are located inside ring 5.

At this point, plate 18 is restored to the raised position; elements 6 are compacted against plate 18; and the next ring 5 is formed in the same way as described above.

The ring forming method implemented by machine 1 therefore provides, above all, for producing brushes 2 not only of superior quality and performance, but also of the same quality standard. That is, between shears 11 and forming station 60, elements 6 are connected at all times to a reference and retaining body defined along the first portion of path P by guide 14 and, between guide 14 and station 60, by bead A of elastic adhesive material and by wire portion 49 internally reinforcing the adhesive material.

As soon as the adhesive material sets, row 17 may therefore be curved easily with no risk of elements 6 slipping in directions parallel to the planes of elements 6, and more specifically, may be curved with no need for skilled labour or specially designed equipment.

Clearly, changes may be made to machine 1 as described and illustrated herein without, however, departing from the scope of the present invention.

In particular, cutting assembly 24 may comprise more than one disk 27, e.g. three, for simultaneously forming a number of parallel grooves 26 in surface 25; in which case, gripper 53 is designed to simultaneously engage a number of wires fed off respective reels, and to insert the wires inside respective grooves 26.

Also, cutting assembly 24 and bonding assembly 42 may be independent of each other, i.e. by dispensing with movable frame 46, and may be formed differently from the example described. Row 17 may be fed continuously to the ring forming station, and the cutting and bonding assemblies may be located in station 15, e.g. in fixed positions, to form groove 26 and deposit the adhesive material inside groove 26 as row 17 travels along path P. In which case, the flexible wire may only be inserted inside groove 26 and embedded in the adhesive material after this is deposited inside groove 26.

Stop plate 18 may be located at such a distance from member 20 that the row of elements compressed between plate 18 and member 20 is of a length equal to a whole multiple of length L of row 17. In which case, a cutting device may be provided between stations 15 and 60 to cut the multiple row into a number of identical rows equal to row 17.

Cutting assembly 24 may be dispensed with, and groove 26 formed by shears 11 forming a groove in each element 6.

Finally, guide 14 may be defined by a U-shaped channel in the case of sheet elements 6 without recesses 12 and from which to form brushes with a solid central hub.

I claim:

1. A method of producing a ring (5) of abrasive sheet elements (6) from which to form a rotary brush (2) comprising a central core (3) and a ring (5) of sheet elements (6) substantially projecting from the central core (3); the method comprising the steps of forming an orderly row (17) of sheet elements (6), and curving the row (17) to form said ring (5); and the method being characterized by comprising the further steps of feeding at least one flexible connecting element (49) towards said row (17) of sheet elements (6); and connecting each of said sheet elements (6) integrally to the flexible connecting element (49) prior to curving said row (17) of sheet elements (6).

2. A method as claimed in claim 1, characterized in that said connecting step comprises the operations of forming on each of said sheet elements (6) at least one groove defining, together with the other grooves, at least one seat (26) for housing said flexible connecting element (49); causing the flexible connecting element (49) to at least partly engage said seat (26); and retaining the flexible connecting element (49) inside said seat (26).

3. A method as claimed in claim 2, characterized in that said grooves are formed by moving said row (17) of sheet elements (6) and at least one rotary cutting tool (27) with respect to each other.

4. A method as claimed in claim 2, characterized in that said seat (26) is formed on a lateral surface (25) of said row (17) of sheet elements, which lateral surface defines at least part of an inner surface of the finished said ring (5) of sheet elements (6).

5. A method as claimed in claim 2, characterized in that connection of said flexible connecting element (49) to said sheet elements (6) comprises a further step of bonding the sheet elements (6) to the flexible connecting element (49).

6. A method as claimed in claim 5, characterized in that said bonding step is performed by depositing a bead (A) of flexible adhesive material inside said seat (26), and at least partly embedding said flexible connecting element (49) inside the adhesive material.

7. A method as claimed in claim 1, characterized in that feeding said flexible connecting element (49) towards said row (17) of sheet elements (6) comprises the steps of unwinding a reel (50) of flexible material, and cutting said flexible material transversely to form said flexible connecting element (49).

8. A machine (1) for producing a ring of abrasive sheet elements (6) from which to form a rotary brush (2) comprising a central core (3) and a ring (5) of sheet elements (6) substantially projecting from the central core (3); the machine (1) comprising forming means (11)(16) for forming an orderly row (17) of sheet elements (6), which is curved to form said ring (5); and the machine being characterized by comprising first feeding means (50)(52) for feeding at least one flexible connecting element (49) towards said row (17) of sheet elements (6); and connecting means (42) for connecting each of said sheet elements (6) integrally to said flexible connecting element (49) prior to curving said row (17) of sheet elements (6) to form said ring (5).

9. A machine as claimed in claim 8, characterized by also comprising guide means (14) for guiding said row (17) along a supply path (P) of the row (17) itself; and cutting means (24) for forming on each of said sheet elements (6) at least one groove defining, together with the other grooves (12), a seat (26) for at least partly housing said flexible connecting element (49); second feeding means (58) being provided for engaging said flexible connecting element (49) at least partly inside said seat (26); and retaining means (59) being provided to hold the flexible connecting element (49) inside said seat (26).

10. A machine as claimed in claim 9, characterized in that said cutting means (24) comprise at least one rotary tool (27); and first actuating means (35, 37) for moving the rotary tool (27) and said row (17) of sheet elements (6) with respect to each other and parallel to said path (P) to form said seat (26).

11. A machine as claimed in claim 10, characterized by also comprising second actuating means (36, 38) for moving said rotary tool (27) between a cutting position in which the rotary tool (27) cooperates with a surface (25) of said row (17) of sheet elements (6) defining an inner surface of said ring (5), and a rest position in which the rotary tool (27) is located to one longitudinal side of said row (17).

12. A machine as claimed in claim 10, characterized by comprising a connecting station (15) located along said path (P) and far connecting said sheet elements (6) to one another; and retaining means (18, 20) for retaining said row (17) in said connecting station (15); said rotary tool (27) and said connecting means (42) being located at said connecting station (15).

13. A machine as claimed in claim 9, characterized in that said first (50)(52) and second (58) feeding means comprise a single gripping assembly (53) for positively engaging an end portion of said flexible connecting element (49).

14. A machine as claimed in claim 9, characterized in that said flexible connecting element (49) is formed from a continuous elongated element wound on a reel (50); said first (50)(52) and second (58) feeding means defining an unwinding assembly for unwinding said reel (50); and cutting means (54) being provided for transversely cutting said elongated element to form said flexible connecting element (49).

15. A machine as claimed in claim 9, characterized in that said retaining means comprise catch means (59) for retaining at least an end portion of said flexible connecting element (49) in a fixed position with respect to said row (17).

16. A machine as claimed in claim 9, characterized in that said connecting means comprise bonding means (42) for bonding said flexible connecting element (49) to said sheet elements (6).

17. A machine as claimed in claim 16, characterized in that said bonding means (42) comprise dispensing means (43) for depositing inside said seat (26) a bead (A) of flexible adhesive material at least partly embedding said flexible connecting element (49).

18. A machine as claimed in claim 17, characterized by comprising third actuating means (45) for moving said dispensing means (43) and said row (17) with respect to each other in a direction parallel to said path (P); and further actuating means (31, 38) for moving said dispensing means (43) between an operating position in which said dispensing means (43) deposit said adhesive material inside said seat (26), and a rest position in which said dispensing means (43) extend to one longitudinal side of said row (17).

* * * * *